US009240652B2

(12) United States Patent
Dai et al.

(10) Patent No.: US 9,240,652 B2
(45) Date of Patent: Jan. 19, 2016

(54) PROTECTION DEVICE FOR PROTECTING A POWER CABLE CONNECTOR AND RELATED POWER SUPPLY AND ELECTRONIC SYSTEM

(71) Applicant: Wistron Corporation, New Taipei (TW)

(72) Inventors: Hsih-Bin Dai, New Taipei (TW); Kuan-Chieh Chen, New Taipei (TW); Cheng-Lan Lee, New Taipei (TW); Yi-Sheng Kao, New Taipei (TW)

(73) Assignee: Wistron Corporation, Hsichih, New Taipei (TW)

( * ) Notice: Subject to any disclaimer, the term of this patent is extended or adjusted under 35 U.S.C. 154(b) by 203 days.

(21) Appl. No.: 14/044,889

(22) Filed: Oct. 3, 2013

(65) Prior Publication Data

US 2014/0179138 A1 Jun. 26, 2014

(30) Foreign Application Priority Data

Dec. 21, 2012 (TW) ..... 101149134 A

(51) Int. Cl.

| | |
|---|---|
| ***H01R 13/60*** | (2006.01) |
| ***H01R 13/635*** | (2006.01) |
| *H01R 13/62* | (2006.01) |
| *H01R 24/66* | (2011.01) |

(52) U.S. Cl.

CPC ..... *H01R 13/635* (2013.01); *H01R 13/6205* (2013.01); *H01R 24/66* (2013.01)

(58) Field of Classification Search

CPC ..... H01R 13/625; H01R 13/2421; H01R 13/633; H01R 11/30; H01R 33/22

USPC ..... 439/39, 152, 340

See application file for complete search history.

(56) References Cited

U.S. PATENT DOCUMENTS

| | | | | |
|---|---|---|---|---|
| 7,637,747 | B2 * | 12/2009 | Jaatinen | A61B 5/0408 439/39 |
| 8,138,717 | B2 * | 3/2012 | Chatterjee | G06F 3/03543 320/107 |
| 8,177,560 | B2 | 5/2012 | Rohrbach | |
| 8,907,783 | B2 * | 12/2014 | Fish | H01R 13/6205 340/539.12 |
| 2008/0146058 | A1 | 6/2008 | Nugent | |

FOREIGN PATENT DOCUMENTS

| | | | |
|---|---|---|---|
| CN | 202050089 | U | 11/2011 |
| CN | 102801044 | A | 11/2012 |

OTHER PUBLICATIONS

Office action mailed on Jul. 30, 2015 for the China application No. 201210590522.2, p. 3 line 5-42, p. 4 and p. 5 line 1-31.

* cited by examiner

*Primary Examiner* — Hien Vu
(74) *Attorney, Agent, or Firm* — Winston Hsu; Scott Margo

(57) ABSTRACT

A protection device for protecting a power cable connector includes one sensor, a separation mechanism and a processing unit. The sensor is for sensing a relative distance and a moving speed of an external object. The separation mechanism is connected to the power cable connector in a separable manner. The processing unit is electrically connected to the sensor for controlling the separation mechanism to separate from the power cable connector as the sensor senses that the relative distance is less than a separation distance and the moving speed is not zero.

20 Claims, 8 Drawing Sheets

PROTECTION DEVICE FOR PROTECTING A POWER CABLE CONNECTOR AND RELATED POWER SUPPLY AND ELECTRONIC SYSTEM

BACKGROUND OF THE INVENTION

1. Field of the Invention

The present invention relates to a protection device for protecting a power cable connector, and more particularly, to a protection device capable of controlling a separation mechanism to separate a power cable connector according a sensed relative distance and a sensed moving speed of an external object.

2. Description of the Prior Art

Generally, a battery disposed inside the existing electronic device does not provide enough power for long-term working of the electronic device, so that a power cable connected to the power supply to receive the sufficient power is utilized as the electronic device executes the complex and consumptive programs for a while. However, the power supply and the power cable stretch across an aisle when the electronic device is used in the public place, such as the coffee cafe and the buffet counter, the moving object (such as the passerby) may be stumbled by the power cable easily, and the electronic device probably drops on the ground that results in hardware damage because the power cable is stumbled by the object. Therefore, design of a protection device for protecting the electronic device is an important issue in the computer mechanical design industry.

SUMMARY OF THE INVENTION

The present invention provides a protection device capable of automatically separating the power cable connector when an external object is close to the power supply for solving above drawbacks.

According to the claimed invention, a protection device for protecting a power cable connector is disclosed. The protection device includes a sensor, a separation mechanism and a processing unit. The sensor senses a relative distance and a moving speed of an external object. The separation mechanism is detachably connected to the power cable connector. The processing unit is electrically connected to the sensor for controlling the separation mechanism to separate from the power cable connector as the sensor senses that the relative distance is smaller than a separation distance and the moving speed is not equal to zero.

According to the claimed invention, the power cable connector includes a magnetic component. The separation mechanism is an electromagnetic mechanism for generating a magnetic pole having the same magnetic property as the magnetic component of the power cable connector, so as to generate a repulsive force to separate the power cable connector from the separation mechanism.

According to the claimed invention, the separation mechanism includes at least one engaging component and an elastic component. The at least one engaging component is detachably engaged with the power cable connector. The elastic component provides a recovering force to the power cable connector when the processing unit drives the at least one engaging component to detach from the power cable connector, so as to separate the power cable connector from the separation mechanism.

According to the claimed invention, the separation mechanism includes an ejecting bar and a pushing component. The ejecting bar is for moving the power cable connector. The pushing component is connected to the ejecting bar. The processing unit drives the pushing component to push the ejecting bar, so that the ejecting bar moves the power cable connector to be out of the separation mechanism.

According to the claimed invention, the protection device further includes an alarm unit electrically connected to the processing unit. The processing unit further controls the alarm unit to generate an alarm prompt when the relative distance is smaller than an alarm distance and greater than the separation distance.

According to the claimed invention, the alarm unit is an audio component, a light emitting component or a vibrating component.

According to the claimed invention, the sensor includes two sensing units respectively for sensing two relative directions.

According to the claimed invention, a power supply includes a power cable connector, a power cable and a main body. The power cable is connected to the power cable connector. The main body includes a supply connector, a separation mechanism, a sensor and a processing unit. The supply connector is detachably connected to the power cable connector. The sensor senses a relative distance and a moving speed of an external object. The processing unit is electrically connected to the sensor for controlling the separation mechanism to separate the power cable connector from the supply connector as the sensor senses that the relative distance is smaller than a separation distance and the moving speed is not equal to zero.

According to the claimed invention, the separation mechanism includes at least one engaging component and an elastic component. The at least one engaging component is detachably engaged with the power cable connector. The elastic component provides a recovering force to the power cable connector when the processing unit drives the at least one engaging component to detach from the power cable connector, so as to separate the power cable connector from the separation mechanism.

According to the claimed invention, the separation mechanism includes an ejecting bar and a pushing component. The ejecting bar is for moving the power cable connector. The pushing component is connected to the ejecting bar. The processing unit drives the pushing component to push the ejecting bar, so that the ejecting bar moves the power cable connector to be out of the separation mechanism.

According to the claimed invention, the protection device further includes an alarm unit electrically connected to the processing unit. The processing unit further controls the alarm unit to generate an alarm prompt when the relative distance is smaller than an alarm distance and greater than the separation distance.

According to the claimed invention, an electronic system includes an electronic device and a power supply. The electronic device includes a display unit. The power supply includes a power cable connector, a power cable and a main body. The power cable is connected to the power cable connector. The main body includes a supply connector, a separation mechanism, a sensor and a processing unit. The supply connector is detachably connected to the power cable connector. The sensor senses a relative distance and a moving speed of an external object. The processing unit is electrically connected to the sensor for controlling the separation mechanism to separate the power cable connector from the supply connector as the sensor senses that the relative distance is smaller than a separation distance and the moving speed is not equal to zero.

According to the claimed invention, the processing unit further outputs a first displaying signal to the electronic device when the power cable connector is separated from the separation mechanism, so that the display unit of the electronic device performs a separated mode icon.

According to the claimed invention, the processing unit further outputs a second displaying signal to the electronic device when the relative distance is smaller than an alarm distance and greater than the separation distance, so that the display unit of the electronic device performs an alarm mode icon. The processing unit further outputs a third displaying signal to the electronic device when the relative distance is smaller than a prompt distance and greater than the alarm distance, so that the display unit of the electronic device performs a prompt mode icon. The processing unit further outputs a fourth displaying signal to the electronic device when the relative distance is greater than the prompt distance, so that the display unit of the electronic device performs a normal mode icon.

According to the claimed invention, the separation distance is within a range from 0 centimeter to 25 centimeters, the alarm distance is within a range from 25 centimeters to 35 centimeters, and the prompt distance is within a range from 35 centimeters to 50 centimeters.

The present invention utilizes the sensor to detect the relative distance and the moving speed of the external object, and further utilizes the processing unit to control the separation mechanism connected to the power cable connector. As the object is at any relative distance from the protection device, the processing unit can output the corresponding signal to remind the user of the electronic device, or can control the separation mechanism to separate the power cable connector from the separation mechanism, so as to prevent the human from falling down by the power cable and to prevent the electronic device from dropping on the ground. Thus, the present invention can effectively overcome drawbacks of the conventional electronic device that is easily damaged by dropping on the ground and results in the falling passerby via the power cable.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
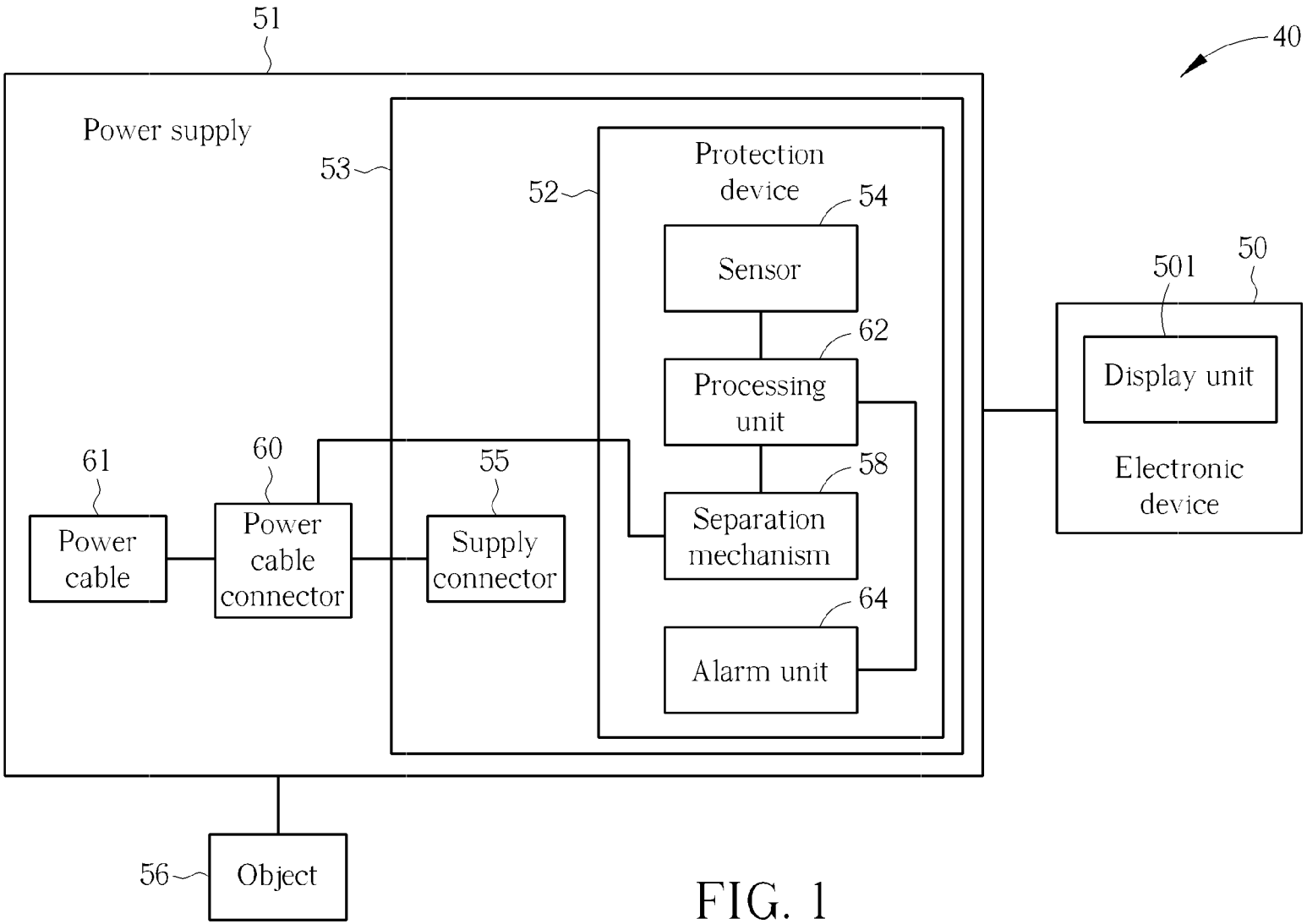
FIG. 1 is a functional block diagram of an electronic system according to an embodiment of the present invention.
Figure 2:
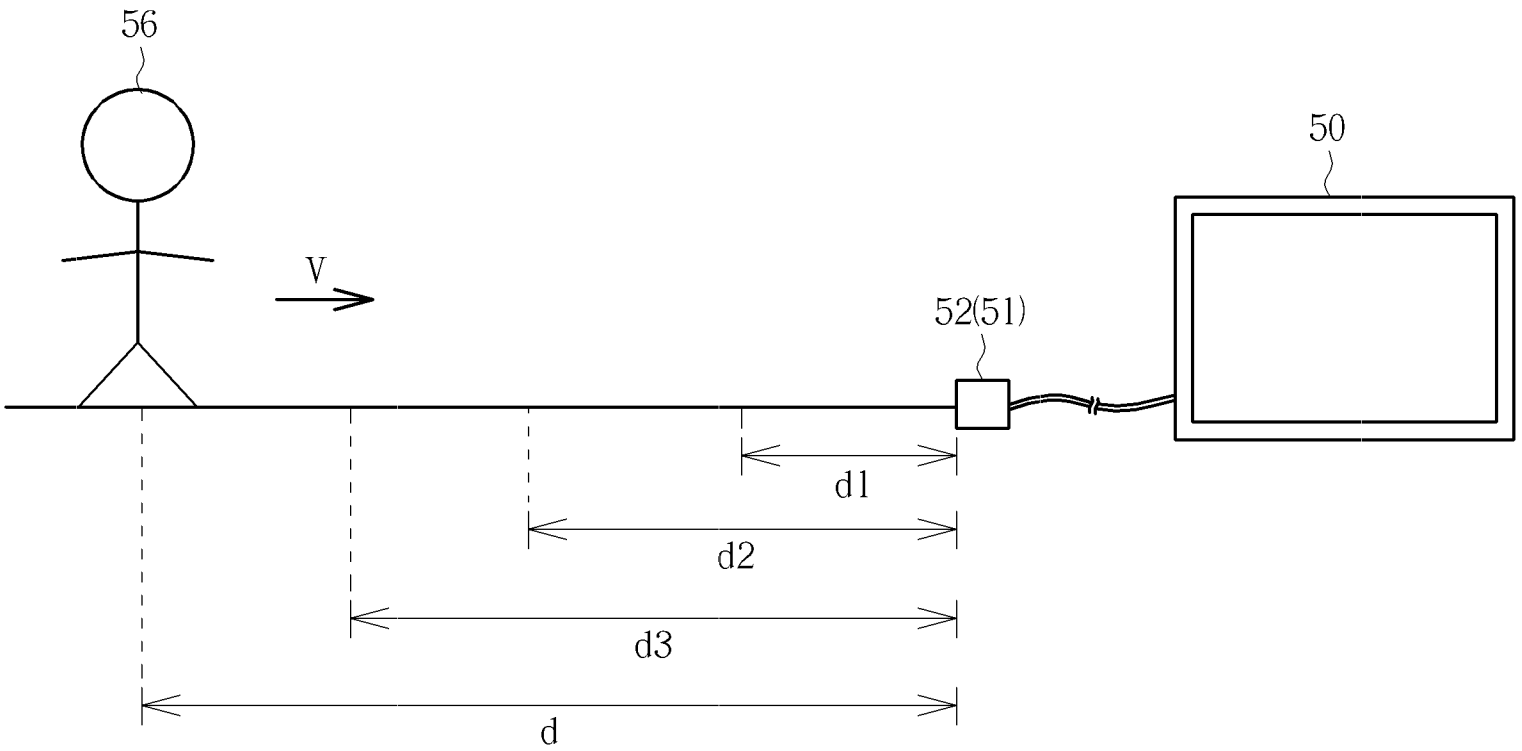
FIG. 2 is a diagram of an external object 56 and a protection device of the power supply 51 according to the embodiment of the present invention.
Figure 3:
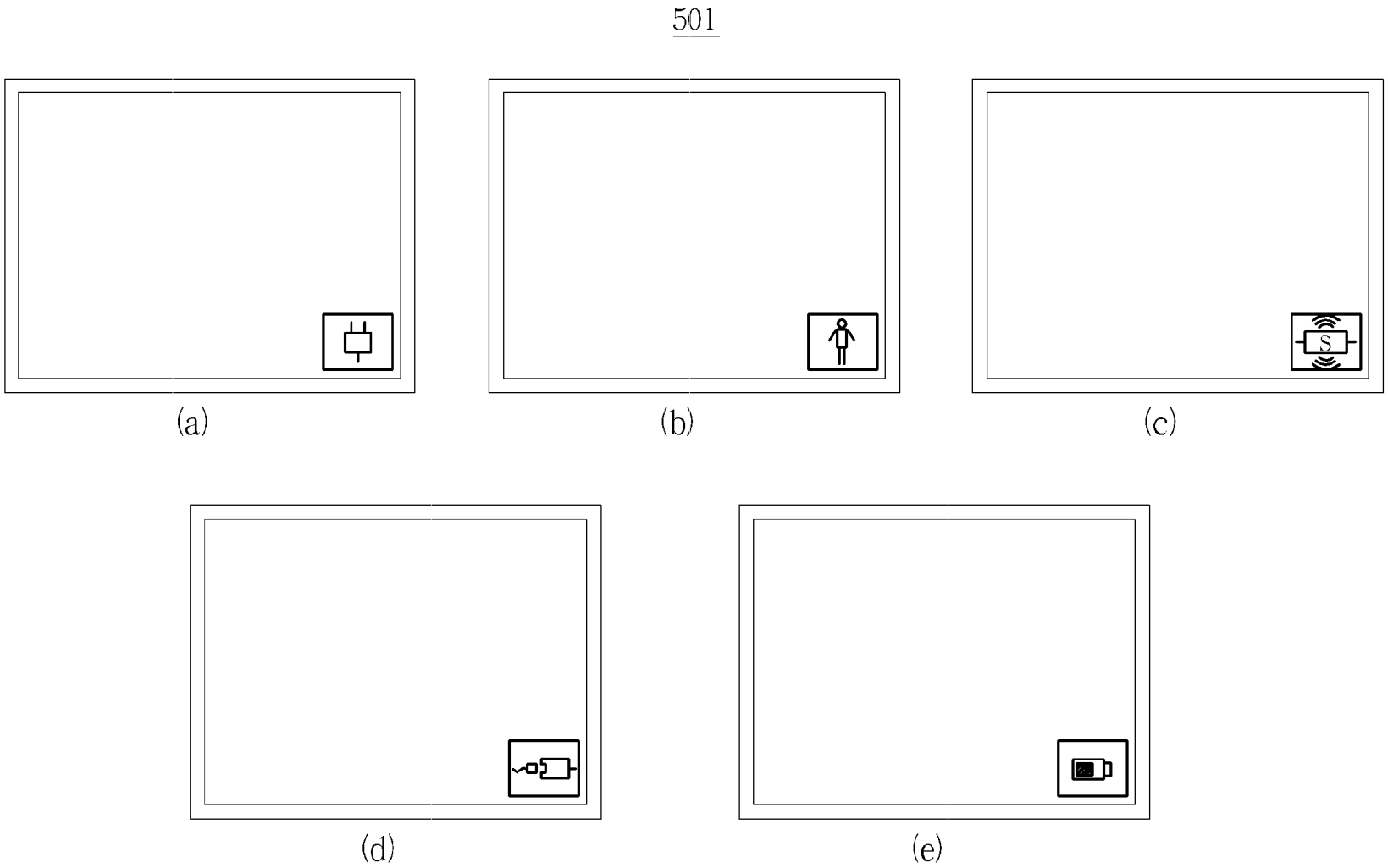
FIG. 3 is a diagram of a display unit 501 of an electronic device performing different icons according to the embodiment of the present invention.

Please refer to FIG. 1 to FIG. 3. FIG. 1 is a functional block diagram of an electronic system 40 according to an embodiment of the present invention. The electronic system 40 includes an electronic device 50 and a power supply 51. The electronic device 50 includes a display unit 501. The power supply 51 includes a main body 53, a power cable connector 60, and a power cable 61 connected to the power cable connector 60. The main body 53 includes a protection device 52 and a supply connector 55. FIG. 2 is a diagram of an external object 56 and the protection device 52 of the power supply 51 according to the embodiment of the present invention. FIG. 3 is a diagram of the display unit 501 of the electronic device 50 performing different icons according to the embodiment of the present invention. The electronic device 50 of the present invention can be a notebook computer, which can receive electricity from an external power source. For example, the notebook computer can utilize the power supply to electrically connect an indoor power source receptacle to obtain the electricity. The protection device 52 can protect the power cable connector 60. The protection device 52 includes a sensor 54 for sensing a relative distance d and a moving speed v of the external object 56. The sensor 54 can be an infrared proximity, an ultrasonic sensor, a radar sensor or a laser sensor. Application of the sensor 54 is not limited to the above-mentioned embodiments, and the sensor capable of sensing the relative distance d and the moving speed v of the object 56 belongs to scopes of the present invention.

The notebook computer is a portable electronic device, which is easily taken to the public place for operation, so that the external object 56 can be a human in this embodiment, such as a child or a staff of the public place. The protection device 52 further includes a separation mechanism 58 detachably connected to a power cable connector 60 of the electronic device 50. The power cable connector 60 is a part of the power supply 51. The protection device 52 further includes a processing unit 62 electrically connected to the sensor 54. The processing unit 62 controls the separation mechanism 58 to separate from the power cable connector 60 when the sensor 54 senses that the relative distance d is smaller than a separation distance d1 and the moving speed v is not equal to zero, so as to prevent the object 56 from falling down by the power cable 61 and to prevent the electronic device 50 from dropping on the ground. In the embodiment, the separation distance d1 can be substantially within a range from 0 centimeter to 25 centimeters. It should be mentioned that the object 56 does not move when the relative distance d is smaller than the separation distance d1 and the moving speed v is equal to zero, so the processing unit 62 determines the object 56 is motionless without minacity, and the processing unit 62 does not drive the separation mechanism 58 to separate the power cable connector 60.

As shown in FIG. 2, when the object 56 moves toward the protection device 52, the relative distance d of the object 56 relative to the protection device 52 is smaller than the separation distance d1 and the moving speed v is not equal to zero, the power cable connector 60 is separated from the separation mechanism 58 and the supply connector 55. Meanwhile, the processing unit 62 further outputs a first displaying signal to the electronic device 50, so that the display unit 501 of the electronic device 50 can perform a separated mode icon shown in FIG. 3(*d*) for notifying the user that the power cable connector 60 is separated from the separation mechanism 58 and the supply connector 55. In addition, as shown in FIG. 1, the protection device 52 of the present invention further includes an alarm unit 64 electrically connected to the processing unit 62. The processing unit 62 further controls the alarm unit 64 to generate an alarm prompt when the relative distance d is smaller than an alarm distance d2 and greater than the separation distance d1. Therefore, the processing unit 62 can control the alarm unit 64 to generate the alarm prompt to remind the closing object 56 and the user of the electronic device 50 when the object 56 moves into the alarm distance d2 shown in FIG. 2. In the embodiment, the alarm distance d2 can be substantially within a range from 25 centimeters to 35 centimeters. Besides, the processing unit 62 further outputs a second displaying signal to the electronic device 50 when the relative distance d between the object 56 and the protection device 52 is smaller than the alarm distance d2 and greater than the separation distance d1, so that the display unit 501 of the electronic device 50 can perform an alarm mode icon shown in FIG. 3(*c*). The alarm mode icon can remind the user of the electronic device 50 that the relative distance d between the object 56 and the protection device 52 is smaller than the alarm distance d2, so that the user can instantly react to ask the closing object 56 to be spaced from the protection device 52.

In addition, when the object 56 moves toward the protection device 52 and the relative distance d of the object 56 relative to the protection device 52 is smaller than a prompt distance d3 and greater than the alarm distance d2, the processing unit 62 further outputs a third displaying signal to the electronic device 50, and the display unit 501 of the electronic device 50 can perform a prompt mode icon shown in FIG. 3(*b*). When the relative distance d between the object 56 and the protection device 52 is greater than the prompt distance d3, the processing unit 62 further outputs a fourth displaying signal to the electronic device 50, and the display unit 501 of the electronic device 50 can perform a normal mode icon shown in FIG. 3(*a*). In the embodiment, the prompt distance d3 can be substantially within a range from 35 centimeters to 50 centimeters. It should further be mentioned that the display unit 501 of the electronic device 50 can perform a battery mode icon shown in FIG. 3(*e*) when a built-in battery of the electronic device 50 provides the electricity.

Figure 4:
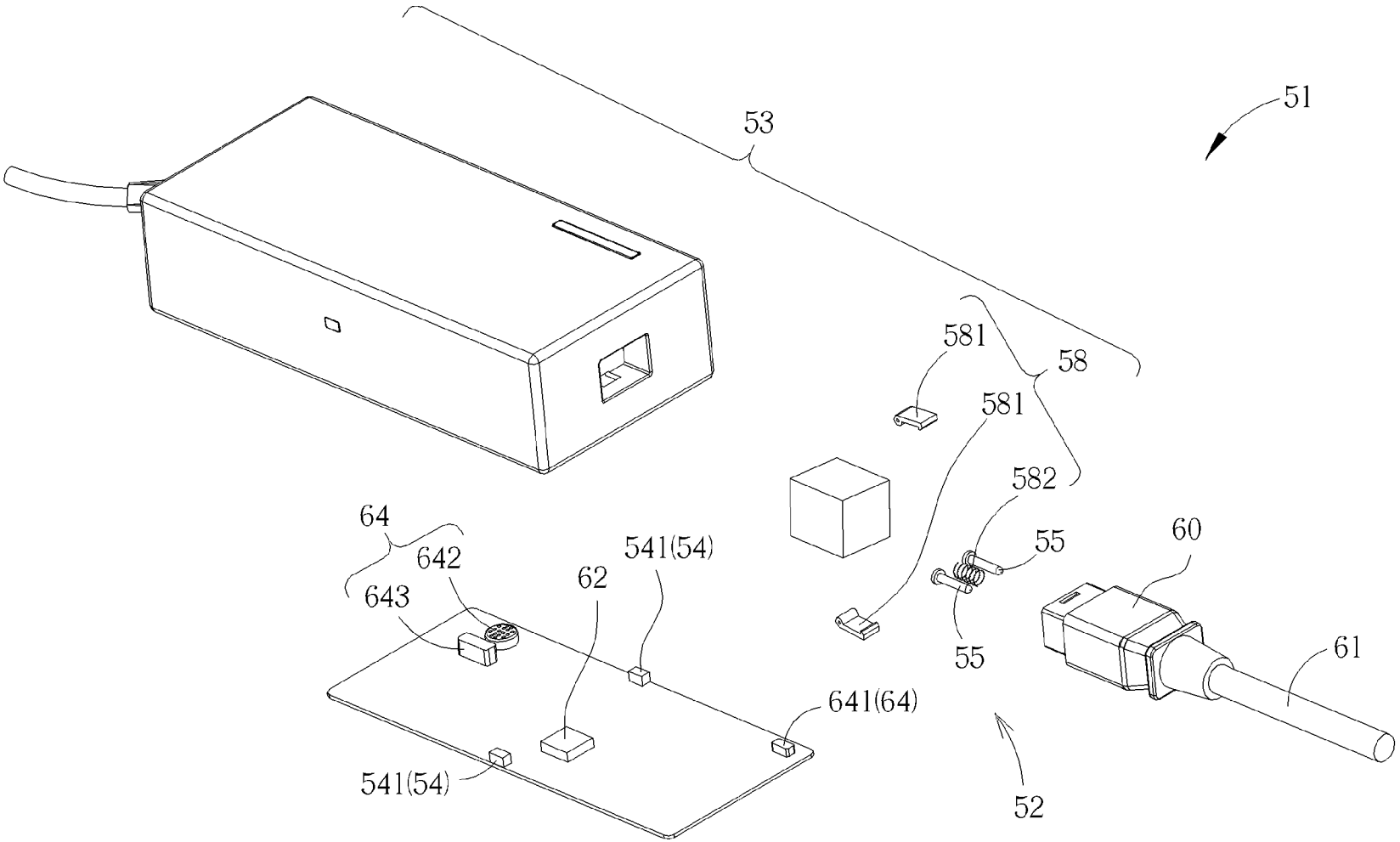
FIG. 4 is an exploded diagram of a power supply according to the embodiment of the present invention.
Figure 5:
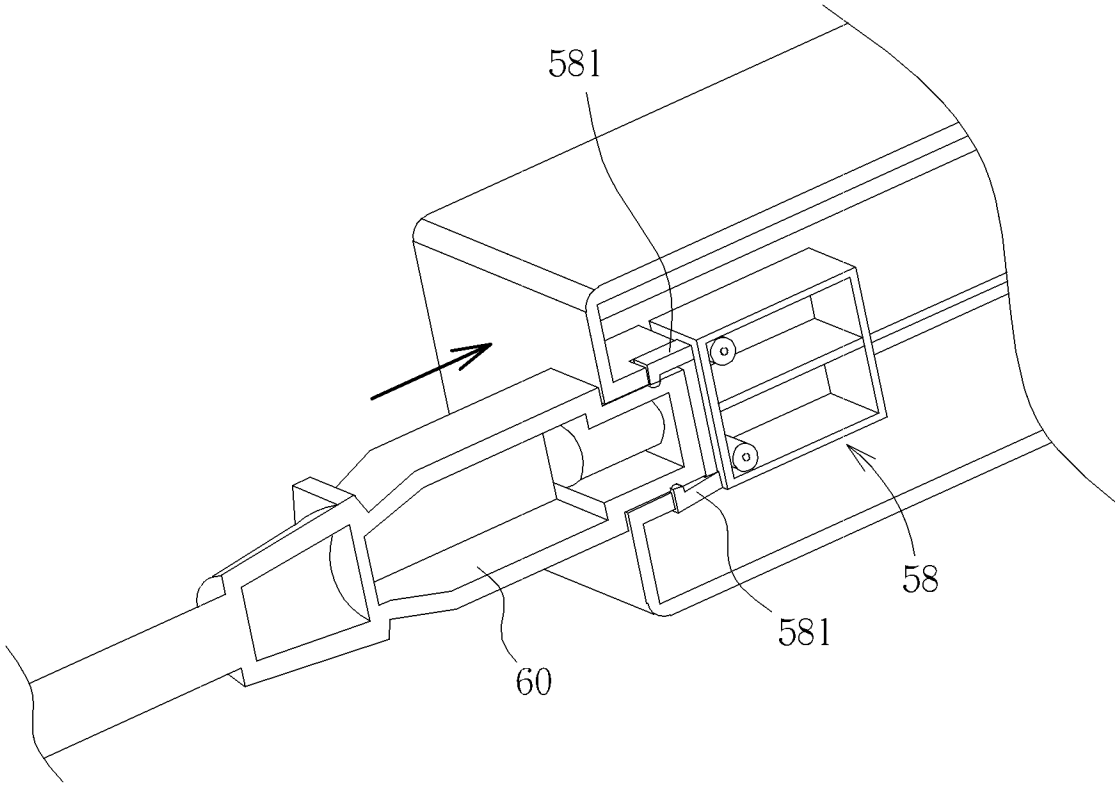
FIG. 5 is an internally structural diagram of a power cable connector connected to a separation mechanism according to the embodiment of the present invention.
Figure 6:
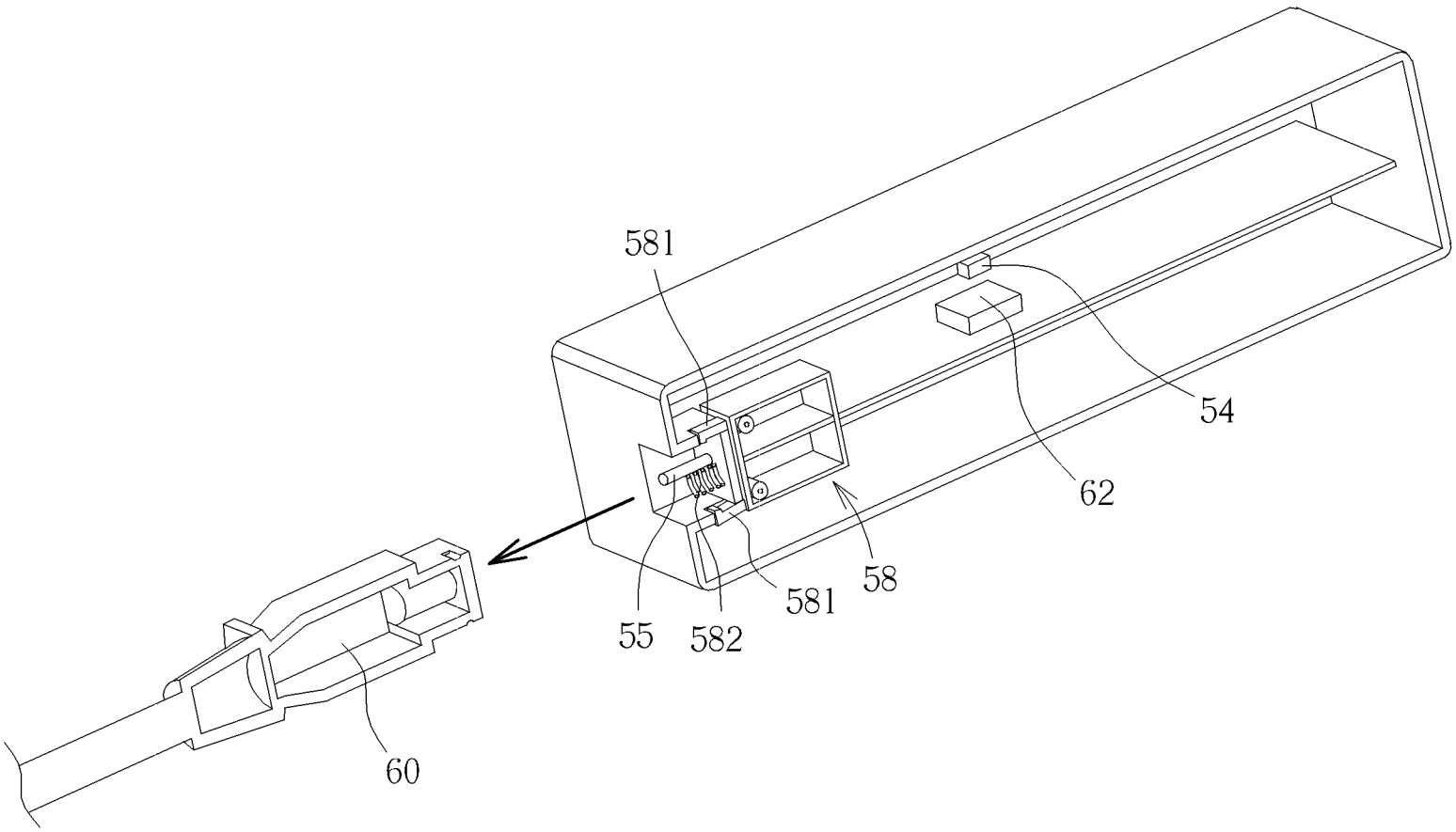
FIG. 6 is an internally structural diagram of the power cable connector separated from the separation mechanism according to the embodiment of the present invention.

Please refer to FIG. 4 to FIG. 6. FIG. 4 is an exploded diagram of the power supply 51 according to the embodiment of the present invention. FIG. 5 is an internally structural diagram of the power cable connector 60 connected to the separation mechanism 58 according to the embodiment of the present invention. FIG. 6 is an internally structural diagram of the power cable connector 60 separated from the separation mechanism 58 according to the embodiment of the present invention. As shown in FIG. 4, the power supply 51 of the present invention includes the main body 53, the power cable connector 60, and the power cable 61 connected to the power cable connector 60. The main body 53 includes the protection device 52 and the supply connector 55. In the embodiment, the sensor 54 of the protection device 52 can include two sensing units 541 respectively for sensing two relative directions. The protection device 52 further includes the processing unit 62 and the alarm unit 64. The alarm unit 64 can be a light emitting component 641, an audio component 642, a vibrating component 643 and so on. The light emitting component 641 can transmit an alarm beam, such as twinkling light. The audio component 642 can generate an alarm sound. The vibrating component 643 can generate alarm vibration. In addition, the separation mechanism 58 further includes at least one engaging component 581 and an elastic component 582. The at least one engaging component 581 is detachably engaged with the power cable connector 60. The elastic component 582 provides a recovering force to the power cable connector 60 when the processing unit 62 drives the at least one engaging component 581 to detach from the power cable connector 60, so as to separate the power cable connector 60 from the separation mechanism 58. As shown in FIG. 5, the separation mechanism 58 includes two engaging components 581. The power cable connector 60 moves along an arrow direction to be engaged with the engaging components 581 respectively disposed on an upper side and a low side of the separation mechanism 58, and then the elastic component 582 shown in FIG. 4 is compressed to store the resilient recovering force. When the relative distance d between the object 56 (shown in FIG. 2) and the protection device 52 is smaller than the separation distance d1 and the moving speed v is not equal to zero, the processing unit 62 drives the engaging components 581 of the separation mechanism 58 to detach from the power cable connector 60. At the time, the elastic component 582 provides the recovering force to the power cable connector 60, so as to push the power cable connector 60 to separate from the separation mechanism 58 and the supply connector 55 along an arrow direction shown in FIG. 6.

Figure 7:
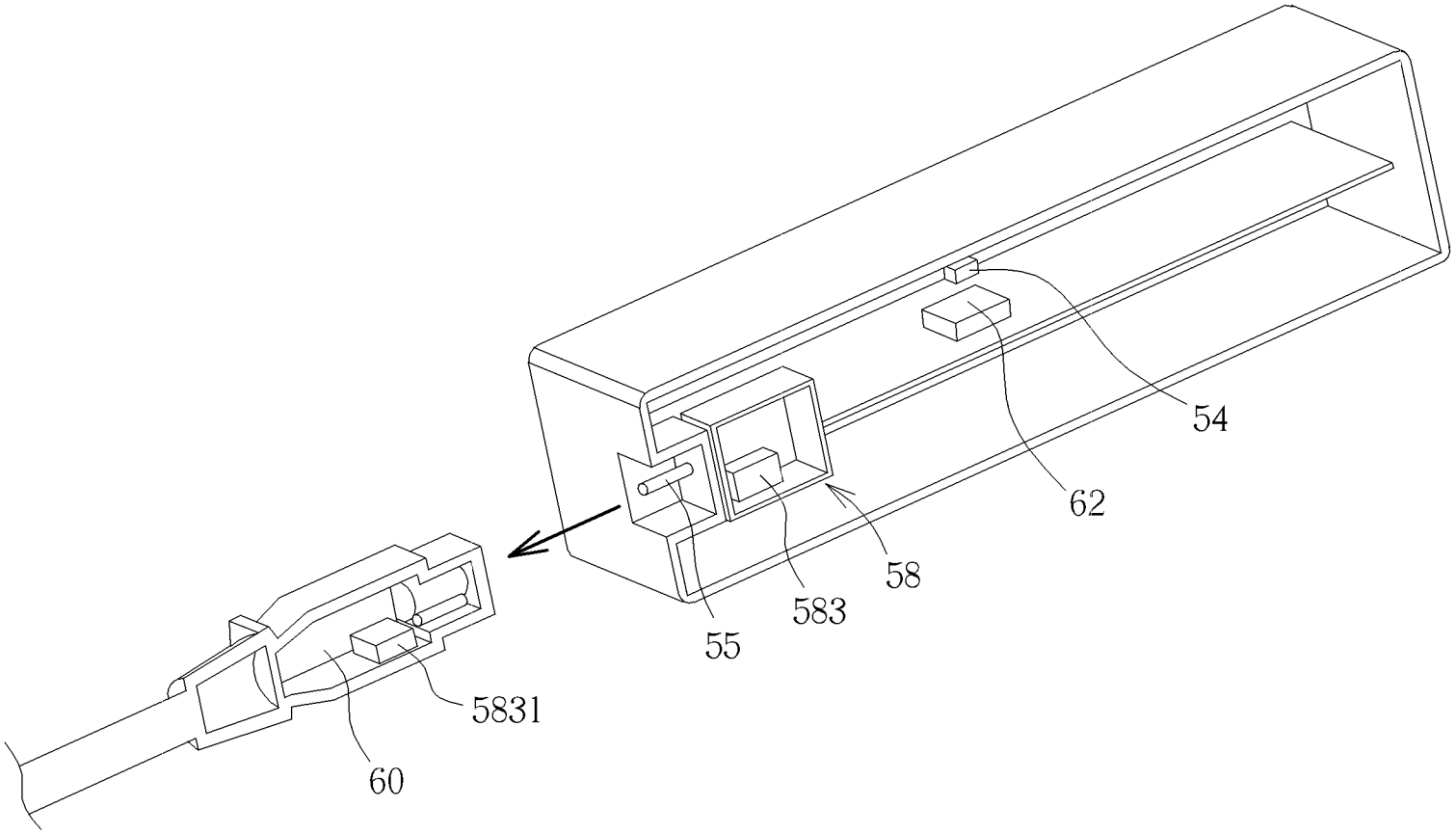
FIG. 7 is a diagram of the power cable connector separated from the separation mechanism according to the other embodiment of the present invention.

Please refer to FIG. 7. FIG. 7 is a diagram of the power cable connector 60 separated from the separation mechanism 58 according to the other embodiment of the present invention. In this embodiment, the separation mechanism 58 can be an electromagnetic mechanism, which includes an electromagnet 583. The power cable connector 60 includes an magnetic component 5831, and the magnetic component 5831 can be a permanent magnet. The electromagnetic mechanism can generate a magnetic pole having the same magnetic property as the magnetic component 5831 of the power cable connector 60, so as to generate a repulsive force to separate the power cable connector 60 from the separation mechanism 58. When the relative distance d between the object 56 (shown in FIG. 2) and the protection device 52 is smaller than the separation distance d1 and the moving speed v is not equal to zero, the processing unit 62 drives the electromagnet 583 to generate the magnetic pole having the same magnetic property as the power cable connector 60, so that the power cable connector 60 can be separated from the separation mechanism 58 by the magnetic repulsive force of the electromagnet 583. For example, the processing unit 62 can drive the electromagnet 583 to generate the magnetic pole with an N pole when the permanent magnet has the N pole, and the magnetic repulsive force can be generated to separate the power cable connector 60 from the separation mechanism 58 and the supply connector 55.

Figure 8:
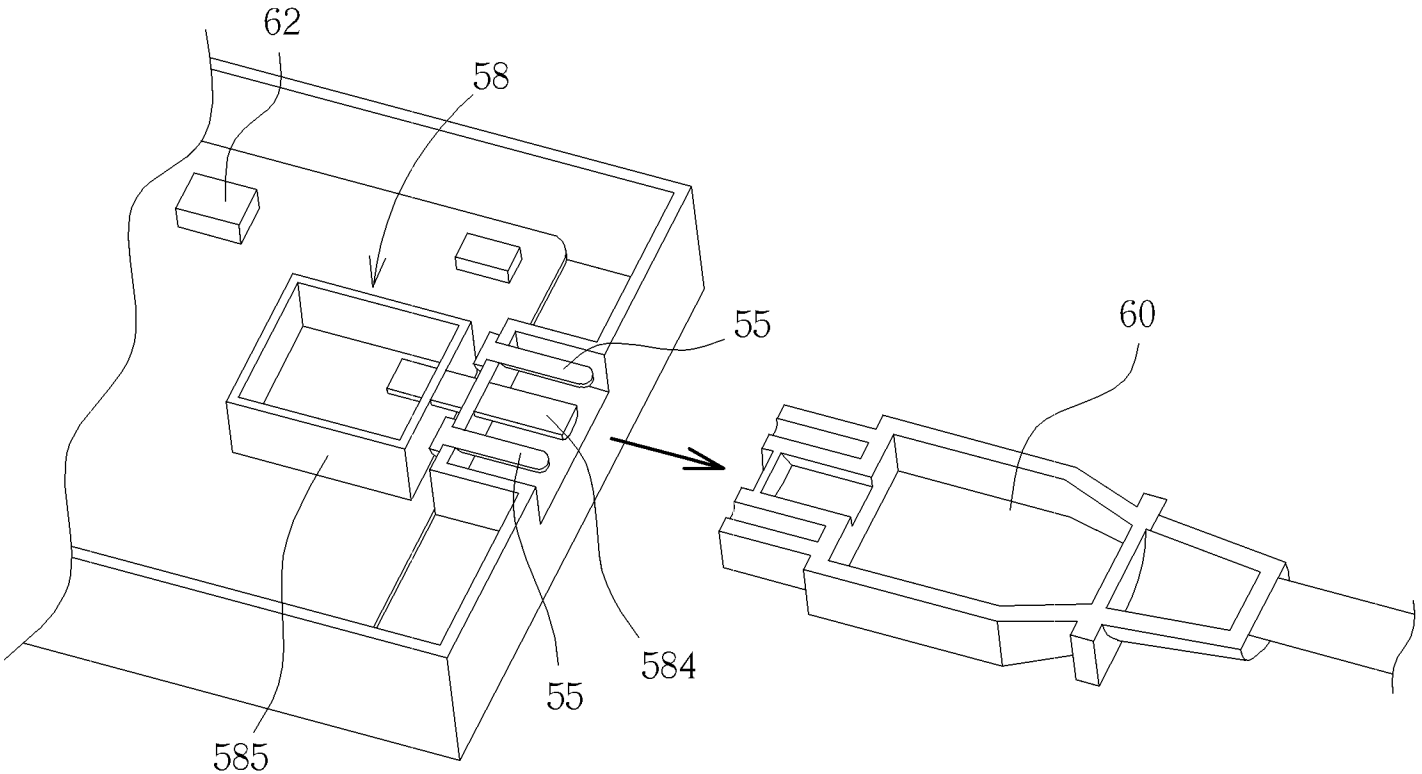
FIG. 8 is a diagram of the power cable connector separated from the separation mechanism according to the other embodiment of the present invention.

Please refer to FIG. 8. FIG. 8 is a diagram of the power cable connector 60 separated from the separation mechanism 58 according to the other embodiment of the present invention. In this embodiment, the separation mechanism 58 includes an ejecting bar 584 and a pushing component 585. The pushing component 585 is connected to the ejecting bar 584 and the ejecting bar 584 can be applied to move out the power cable connector 60. When the relative distance d between the object 56 shown in FIG. 2 and the protection device 52 is smaller than the separation distance d1 and the moving speed v is not equal to zero, the processing unit 62 drives the pushing component 585 to push the ejecting bar 584, and the ejecting bar 584 can move the power cable connector 60 out of the separation mechanism 58. In conclusion, design capable of utilizing the processing unit 62 to separate the separation mechanism 58 from the power cable connector 60 belongs to the scopes of the present invention.

Comparing to the prior art, the present invention utilizes the sensor to detect the relative distance and the moving speed of the external object, and further utilizes the processing unit to control the separation mechanism connected to the power cable connector. As the object is at any relative distance from the protection device, the processing unit can output the corresponding signal to remind the user of the electronic device, or can control the separation mechanism to separate the power cable connector from the separation mechanism, so as to prevent the human from falling down by the power cable and to prevent the electronic device from dropping on the ground. Thus, the present invention can effectively overcome drawbacks of the conventional electronic device that is easily damaged by dropping on the ground and results in the falling passerby via the power cable.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A protection device for protecting a power cable connector, the protection device comprising:

a sensor for sensing a relative distance and a moving speed of an external object;

a separation mechanism detachably connected to the power cable connector, the separation mechanism comprising:

at least one connecting component for detachably engaging with the power cable connector; and a pressing component for providing a force to the power cable connector; and a processing unit electrically connected to the sensor for controlling the separation mechanism to separate from the power cable connector as the sensor senses that the relative distance is smaller than a separation distance and the moving speed is not equal to zero.

2. The protection device of claim 1, wherein the power cable connector comprises a magnetic component, the separation mechanism is an electromagnetic mechanism for generating a magnetic pole having the same magnetic property as the magnetic component of the power cable connector, so as to generate a repulsive force to separate the power cable connector from the separation mechanism when the electromagnetic mechanism generates the magnetic pole.

3. The protection device of claim 1, wherein the at least one connecting component comprises at least one engaging component for detachably engaging with the power cable connector; and the pressing component comprises an elastic component for providing a force to the power cable connector when the processing unit drives the at least one engaging component to detach from the power cable connector, so as to separate the power cable connector from the separation mechanism.

4. The protection device of claim 1, wherein the separation mechanism comprises:

an ejecting bar for moving the power cable connector; and a pushing component connected to the ejecting bar, the processing unit driving the pushing component to push the ejecting bar so that the ejecting bar moves the power cable connector to be out of the separation mechanism.

5. The protection device of claim 1, further comprising:

an alarm unit electrically connected to the processing unit, the processing unit further controlling the alarm unit to generate an alarm prompt when the relative distance is smaller than an alarm distance and greater than the separation distance.

6. The protection device of claim 5, wherein the alarm unit is an audio component, a light emitting component or a vibrating component.

7. The protection device of claim 1, wherein the sensor comprises two sensing units respectively for sensing two relative directions.

8. A power supply comprising:

a power cable connector;

a power cable connected to the power cable connector; and a main body, the main body comprising:

a supply connector detachably connected to the power cable connector;

a separation mechanism, the separation mechanism comprising:

at least one connecting component for detachably engaging with the power cable connector; and a pressing component for providing a force to the power cable connector;

a sensor for sensing a relative distance and a moving speed of an external object; and a processing unit electrically connected to the sensor for controlling the separation mechanism to separate the power cable connector from the supply connector as the sensor senses that the relative distance is smaller than a separation distance and the moving speed is not equal to zero.

9. The power supply of claim 8, wherein the power cable connector comprises a magnetic component, the separation mechanism is an electromagnetic mechanism for generating a magnetic pole having the same magnetic property as the magnetic component of the power cable connector, so as to generate a repulsive force to separate the power cable connector from the separation mechanism when the electromagnetic mechanism generates the magnetic pole.

10. The power supply of claim 8, wherein the at least one connecting component comprises at least one engaging component for detachably engaging with the power cable connector; and the pressing component comprises an elastic component for providing a recovering force to the power cable connector when the processing unit drives the at least one engaging component to detach from the power cable connector, so as to separate the power cable connector from the separation mechanism.

11. The power supply of claim 8, wherein the separation mechanism comprises:

an ejecting bar for moving the power cable connector; and a pushing component connected to the ejecting bar, the processing unit driving the pushing component to push the ejecting bar so that the ejecting bar moves the power cable connector to be out of the separation mechanism.

12. The power supply of claim 8, further comprising:

an alarm unit electrically connected to the processing unit, the processing unit further controlling the alarm unit to generate an alarm prompt when the relative distance is smaller than an alarm distance and greater than the separation distance.

13. An electronic system comprising:

an electronic device, the electronic device comprising a display unit; and a power supply, the power supply comprising:

a power cable connector;

a power cable connected to the power cable connector; and a main body, the main body comprising:

a supply connector detachably connected to the power cable connector;

a separation mechanism detachably connected to the power cable connector, the separation mechanism comprising:

at least one connecting component for detachably engaging with the power cable connector; and a pressing component for providing a force to the power cable connector;

a sensor for sensing a relative distance and a moving speed of an external object; and a processing unit electrically connected to the sensor for controlling the separation mechanism so that the separation drives the power cable connector to separate from the supply connector as the sensor senses that the relative distance is smaller than a separation distance and the moving speed is not equal to zero.

14. The electronic system of claim 13, wherein the power cable connector comprises a magnetic component, the separation mechanism is an electromagnetic mechanism for generating a magnetic pole having the same magnetic property as the magnetic component of the power cable connector, so as to generate a repulsive force to separate the power cable connector from the separation mechanism when the electromagnetic mechanism generates the magnetic pole.

15. The electronic system of claim 13, wherein the at least one connecting component comprises at least one engaging component for detachably engaging with the power cable connector; and the pressing component comprises an elastic component for providing a recovering force to the power cable connector when the processing unit drives the at least one engaging component to detach from the power cable connector, so as to separate the power cable connector from the separation mechanism.

16. The electronic system of claim 13, wherein the separation mechanism comprises:

an ejecting bar for moving the power cable connector; and a pushing component connected to the ejecting bar, the processing unit driving the pushing component to push the ejecting bar so that the ejecting bar moves the power cable connector to be out of the separation mechanism.

17. The electronic system of claim 13, further comprising:

an alarm unit electrically connected to the processing unit, the processing unit further controlling the alarm unit to generate an alarm prompt when the relative distance is smaller than an alarm distance and greater than the separation distance.

18. The electronic system of claim 13, wherein the processing unit further outputs a first displaying signal to the electronic device when the power cable connector is separated from the separation mechanism, so that the display unit of the electronic device performs a separated mode icon.

19. The electronic system of claim 18, wherein the processing unit further outputs a second displaying signal to the electronic device when the relative distance is smaller than an alarm distance and greater than the separation distance so that the display unit of the electronic device performs an alarm mode icon, the processing unit further outputs a third displaying signal to the electronic device when the relative distance is smaller than a prompt distance and greater than the alarm distance so that the display unit of the electronic device performs a prompt mode icon, and the processing unit further outputs a fourth displaying signal to the electronic device when the relative distance is greater than the prompt distance so that the display unit of the electronic device performs a normal mode icon.

20. The electronic system of claim 19, wherein the separation distance is within a range from 0 centimeter to 25 centimeters, the alarm distance is within a range from 25 centimeters to 35 centimeters, and the prompt distance is within a range from 35 centimeters to 50 centimeters.

* * * * *